United States Patent [19]

Pierce et al.

[11] 3,967,428

[45] July 6, 1976

[54] PORTABLE FLOOR CONSTRUCTION

[75] Inventors: Arthur W. Pierce, Milford; Robert A. Stoehr, Cincinnati, both of Ohio

[73] Assignee: Cincinnati Floor Company, Cincinnati, Ohio

[22] Filed: Apr. 29, 1975

[21] Appl. No.: 577,566

Related U.S. Application Data

[63] Continuation of Ser. No. 430,216, Jan. 2, 1974, abandoned.

[52] U.S. Cl. ..... 52/582; 52/629

[51] Int. Cl.[2] ..... E04C 1/30; E04B 1/343

[58] Field of Search ..... 52/578, 581, 584, 586, 52/582, 629

[56] References Cited

UNITED STATES PATENTS

| | | | |
|---|---|---|---|
| 2,138,085 | 11/1938 | Birtles | 52/586 |
| 2,142,388 | 1/1939 | Wallace | 52/584 |
| 2,635,450 | 4/1953 | Orzel | 52/587 |

FOREIGN PATENTS OR APPLICATIONS

| | | | |
|---|---|---|---|
| 662,021 | 7/1938 | Germany | 52/584 |

*Primary Examiner*—Ernest R. Purser
*Assistant Examiner*—James L. Ridgill, Jr.
*Attorney, Agent, or Firm*—Wood, Herron & Evans

[57] ABSTRACT

A portable sectional basketball floor that is quickly and easily assembled and disassembled. The floor comprises a plurality of interfitting panels. Certain panels on the periphery of the floor are rigidly secured together by bolted connections located below the playing surface. The internal panels are connected together by subsurface connections comprising overlying brackets with a vertical hole through each bracket. As the floor is assembled, the cooperating brackets on adjacent panels are slid over one another until the openings in the brackets are aligned. A pin is dropped into each pair of aligned holes from above to lock the floor panels together. When the sectional floor is removed, the pins are quickly and easily disengaged by simply lifting them with a magnet, thereby freeing the panels from one another.

12 Claims, 12 Drawing Figures

A14
160
161
B15
C14
D15
N15
O14
B14
D14
N14
A13
C13
O15
A13
O3
A2
81
120
B3
C2
D3
N3
O2
79
83
89
99
56
B2
190
42
182
A1
D2
N2
141
145
B1
C1
D1
N1
O1

PORTABLE FLOOR CONSTRUCTION

This is a continuation of application Ser. No. 430,216 filed Jan. 2, 1974, now abandoned.

BACKGROUND OF THE INVENTION

This invention relates to sectional floors and especially to sectional floors for use in indoor arenas where a number of sports, such as hockey and basketball, are played which require totally different playing surfaces.

Indoor arenas frequently are used for a number of different sports, such as hockey, basketball, and the like. In many cases, the arena must be converted within a few hours from use with one sport to use with another. Typically, the floor of the arena is connected to a refrigeration system so that the base surface is formed of ice suitable for hockey and other ice skating events. When the arena is to be used for other sports, typically basketball, the arena must be converted by installing a wooden floor. Such floors are usually provided by assembling a large number of sectional floor panels which rest upon the ice. The floor panels must be secured together in such a manner that they provide a flat continuous surface.

The floor panels in prior art floors are connected together generally by one of two different methods. One method has employed countersunk bolts, accessible from above the floor, which pass downwardly through an opening in one panel and threadably engage a bracket element mounted on an adjacent panel. An effort is made to secure the bolts in position with their heads flush to the floor in an attempt to make the floor surface flat. In practice, however, these bolts do not lie completely flush with the surface, but rather present objectionable and hazardous irregularities upon which a player may cut or scrape himself severely. Moreover, there is a second difficulty with such surface mounted bolts in that they tend to sweat due to the fact that they are chilled by the underlying cold surface. This sweating is highly objectionable in that it tends to make the basketball floor slippery. A further objection to this system is that it requires a substantial amount of time to install and dismantle a floor since a large number of bolts must be threaded and during the installation process, the panel openings must be carefully aligned with the underlying threaded bracket openings.

A second method of joining together panels in prior art sectional floors has been to utilize horizontally extending bolts which lie completely under the surface of each floor panel. These bolts are disposed completely below the playing surface so that the floor surface itself is smooth. This second method, like the flush bolt approach, is subject to the objection that it requires a considerable amount of time for installation as well as removal of the floor when the arena is converted from use for hockey to use for basketball and vice versa. Indeed, in the second method even greater amounts of time are required since it is more difficult to align the openings in the horizontal brackets which are below floor level. Also, the bolt holes are located relatively close to the underlying surface which makes it more difficult for the workmen to manipulate the bolts.

OBJECTS OF THE INVENTION

It is the primary objective of the present invention to provide a sectional floor comprising a plurality of interconnected panels which form a flat playing surface and which can be quickly and easily installed and removed.

It is a further objective of the invention to provide a sectional floor in which all connections between adjacent panels are disposed below the playing surface so the playing surface is thus maintained smooth and free from any projections of metal elements which might cause injury or which might sweat and create moisture.

It is an additional objective of the present invention to provide a sectional floor in which the panels are rigidly secured together and yet which requires only a minimum number of threaded connections between certain peripheral panels. All of the interior panels which involve the great majority of connections are joined by simple drop-in pins.

It is a further objective of the present invention to provide a sectional floor which requires a minimum time for installation due to the fact that the final alignment of cooperating brackets on the interior panels is automatically obtained when a drop pin is inserted.

It is a still further objective of the present invention to provide a sectional floor in which the time required for removal of the floor is minimized due to the fact that the pins which interconnect the interior panels are quickly removed by lifting them with a magnet from the bracket openings in which they are received.

BRIEF DESCRIPTION

A portable sectional floor constructed in accordance with the principles of the present invention consists of a large number of rectangular floor panels which are releasably interconnected. The floor panels are disposed in contiguous rows with the panels of one row being staggered with respect to the panels of the two adjacent rows. Each rectangular panel comprises a plurality of parallel stringers or joists which support a subfloor and a finish floor. The joists of each panel also carry a plurality of brackets for interlocking the panel with the adjacent panels.

In accordance with this invention, the panels on at least two, and preferably three, peripheral edges of the floor are rigidly joined together utilizing threaded, i.e., bolt-type, subsurface connectors. The panels of the fourth peripheral edge are joined along the peripheral edge by utilizing horizontal pin connectors. The remaining, or interior, panels constituting approximately three-fourths of the total number of panels are interconnected by means of a novel vertical drop pin connection. This connection comprises two brackets, one associated with each of the panels to be joined. The brackets extend horizontally outwardly, below the playing surface and beyond the confines of each panel, at different vertical elevations, such that when the panels are joined, one bracket slides over the other. Each bracket is provided with a pin-receiving opening. When the panels are properly aligned, these openings are in registry with one another. The brackets are interlocked by dropping a headed pin into the openings, and are unlocked by lifting the pin in any suitable manner, such as by means of a magnet.

In a preferred embodiment of the present invention, the opening in the upper bracket tapers downwardly while the head of the pin is also tapered. Thus, the shank of the pin readily passes through the upper opening and enters the bottom opening even when there is a slight misalignment of the upper and lower brackets. However, as the pin is pressed downwardly, the interaction of the tapered head and tapered opening functions to cause the upper and lower brackets to be brought into full alignment.

In a preferred embodiment of the present invention, the brackets to be interconnected as each new panel is brought into position are always fully accessible. This is achieved by providing each panel with four brackets. Two such brackets extend outwardly from diametrically opposite corners of the panel along lines parallel to the two short edges of the panel. A third bracket extends outwardly from a third corner parallel to a short edge of the panel. The fourth bracket extends outwardly parallel to a short edge from a position approximately halfway along the length of a long edge of the panel. This bracket is positioned so that it extends just alongside the short edge of a second panel to be joined in staggered relationship.

In the preferred embodiment, the various brackets are formed of angle members which are bolted to the adjacent joists of the panel member. Consequently, the present connector members are advantageous not only because they expedite installation and removal of the floor, but are further advantageous since they do not add appreciably to the overall cost of the floor construction.

DESCRIPTION OF THE DRAWINGS

These and other objects and advantages of the present invention will become more readily apparent from the following detailed description of a preferred embodiment of the invention as shown in the drawings which form a part of the disclosure.

In the drawings.

DETAILED DESCRIPTION

Figure 1:
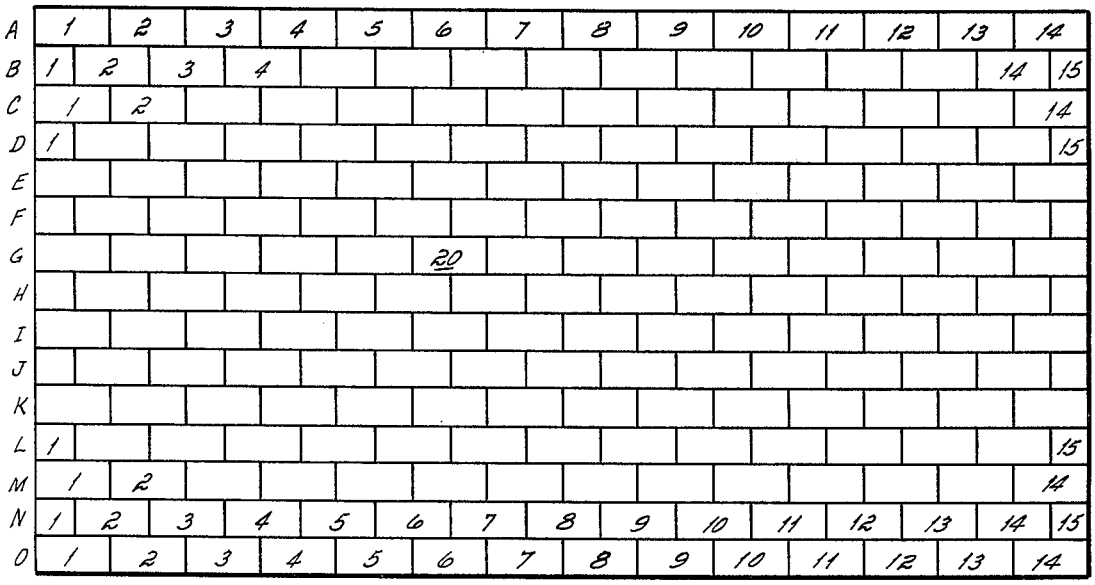
FIG. 1 is a plan view of an assembled sectional floor.

FIG. 1 is a plan view of a sectional floor constructed in accordance with the present invention. As there shown, the floor, which typically might be approximately 112 by 60 feet, is constituted by a plurality of individual panels disposed in contiguous rows. The rows of floor panels are labeled along the left edge as A, B, . . . N and O. Each row includes a plurality of identical panels (except for the half panels in alternate rows) disposed end to end, the panels of each row being numbered sequentially from left to right. The floor panels in adjacent rows are staggered with the ends of the panels in one row being located adjacent to the middle of the panels of the adjacent row.

Figure 2:
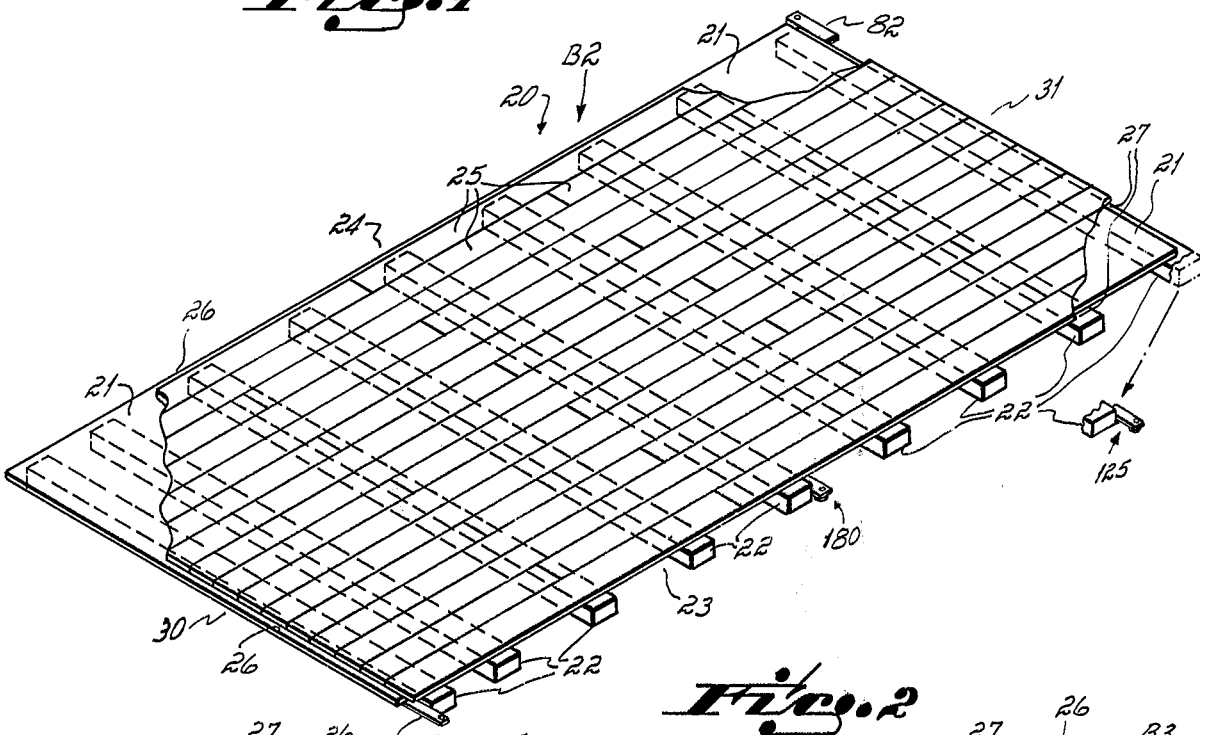
FIG. 2 is a perspective view partially cut away of an interior floor panel of the type used to make a sectional floor as shown in FIG. 1.

The basic construction of each rectangular floor subsection, or panel, is like panel 20 shown in FIG. 2. However, this panel is shown as having the four connecting brackets provided on the interior panels. Panel 20 includes a subfloor 21 mounted on a plurality of joists 22 and carrying finish floor boards 25. Subfloor 21 is preferably made of a 4 × 8 feet plywood sheet, although subfloors of other construction and size may be substituted therefor. The subfloor 21 is supported from below by a plurality of stringers or joists 22 arranged in parallel spaced relation to each other and extending from one long edge 23 of the subfloor to the opposite long edge 24. In one form of panel, these stringers 22 are made of 2 × 3 inches wood and are placed on 12 inch centers. Again, it will be understood that the stringers can be of a different size, e.g., 2 × 4 inches, and can be placed on other centers, e.g., 16 inch centers. The upper surface of the subfloor 21 carries a plurality of floor finish boards 25 whose upper surface is flat and comprises the playing surface of the floor.

The subfloor 21 is preferably offset slightly from the upper, or playing, surface presented by the floor boards 25 to create a tongue 26 and a groove 27. The tongue 26, which comprises a portion of the subfloor 21 extending laterally from below the ends of the floor boards 25, extends along the end 30 and the side edge 24 of the floor section 20. The groove 27, on the other hand, is the recessed area disposed between the lower surface of the floor boards 25 and the upper surface of the stringers 22 along the side 23 and the end 31 of the panel 20. Both the tongues and grooves can be clad with a sheet metal for durability if desired.

Figure 3:
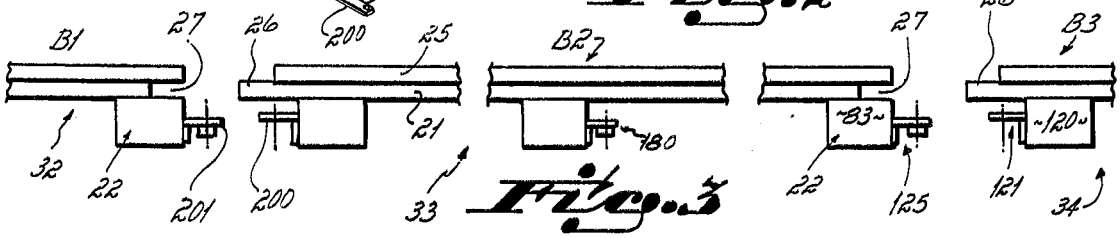
FIG. 3 is a partial vertical side view of three floor panels of the invention showing the manner in which the panels interfit.

As viewed in FIG. 3, when a panel 32 is assembled with a panel 33, the tongue 26 of the panel 33 will interfit with the groove 27 of the panel 32 so as to restrict vertical movement of one panel with respect to the other. In a similar manner, the tongue 26 of the righthand panel 34 interfits with the groove 27 of the floor section 33. The tongues and grooves of all of the panels constituting the completed floor cooperate in this same manner.

Figure 4:
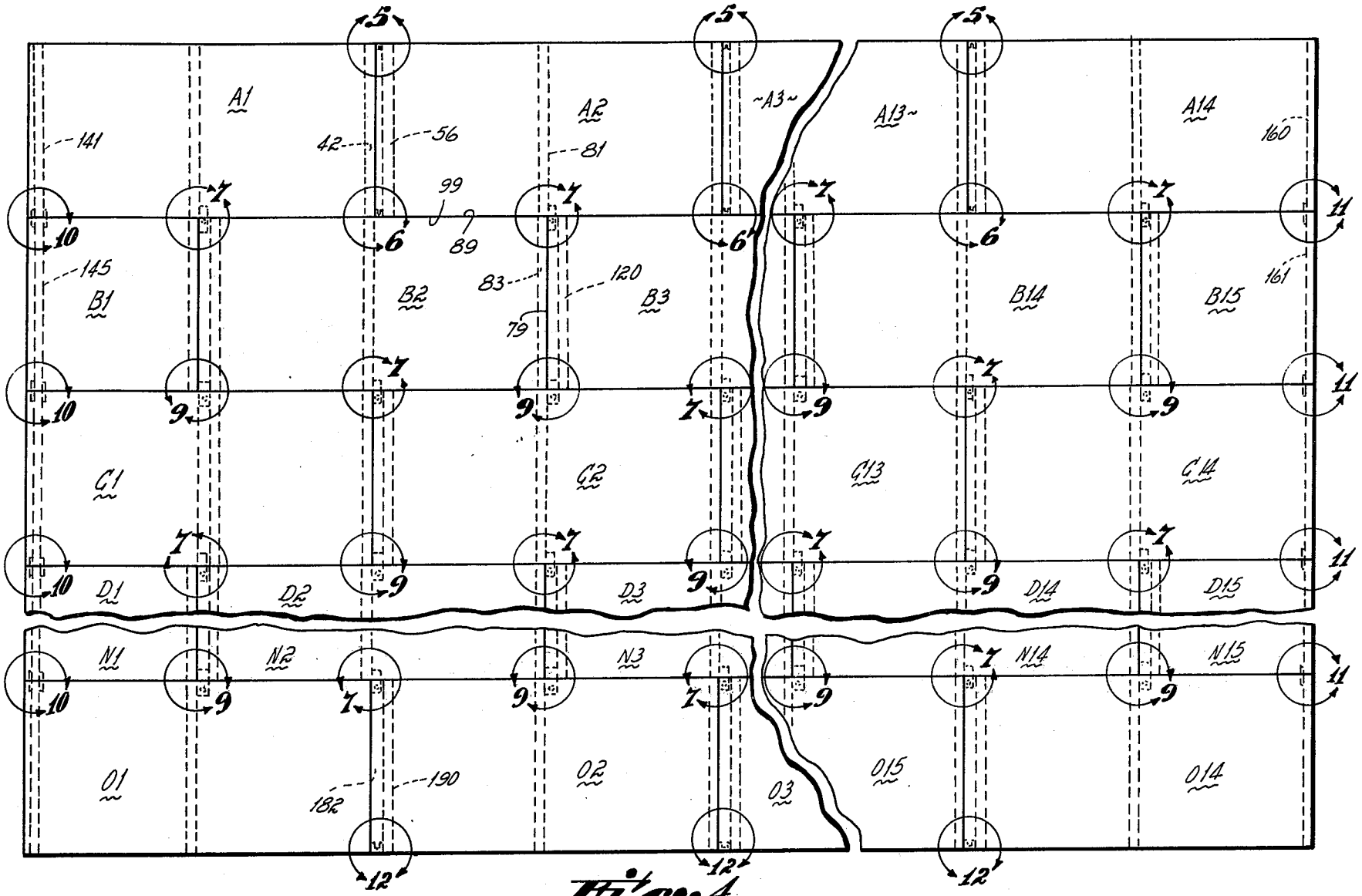
FIG. 4 shows a partial plan view of an assembled floor showing the locations of the various types of inter-panel connector points.

The connector construction for releasably securing the panels in assembled relationship can best be understood by an initial reference to FIG. 4. In that figure, the sectional floor is shown in somewhat greater detail than in FIG. 1 and the various types of connectors utilized are identified by number. More particularly, the labeled circular arrows in FIG. 4 correspond to the locations of connections between floor panels and the numbers associated with the arrows correspond to the figure in which the particular connection is shown in greater detail. For example, the circular arrows labeled 5 identify the connections between the outer edges of floor panels located in the A row. These connections are of the type shown in detail in FIG. 5.

Figure 5:
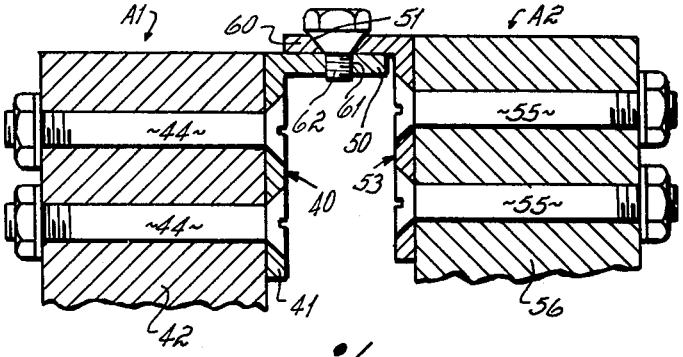
FIG. 5 is a horizontal sectional view taken through the connection between floor sections in the A row in the area designated 5 in FIG. 4, the section being taken at a level below the subfloor and above the connectors.

Referring now to FIG. 5, the connection between panels, such as A1 and A2, along their outer edges is shown. This connection includes a first angle bracket 40 carried by panel A1 and a second angle bracket 53 carried by panel A2. Bracket 40 is preferably made of metal and includes a leg portion shown generally at 41 which is bolted, as by means of bolts 44, to the end stringer 42 of panel A1. The bracket 40 includes an outwardly extending arm 50 having a threaded opening 51. The connection shown in FIG. 5 also includes an angle bracket 53 which is secured as by means of bolts 55 to stringer 56 which comprises the leftmost stringer of panel A2. Angle bracket 53 includes a leg 60 which extends perpendicular to stringer 56 and is provided with a threaded tapered 61. When the edges of the floors of panels A1 and A2 are in abutment, the holes in brackets 40 and 53 are in alignment. These brackets are secured together by means of a bolt 62. Since the angle brackets 40 and 53 are affixed to the stringers 42 and 56, the connection shown in FIG. 5 is disposed entirely beneath the playing surface of the floor sections A1 and A2.

A connection similar to that shown in FIG. 5 is utilized along the inner corners of abutting panels in the A row as indicated by the circular arrows labeled 6 in FIG. 4. This latter connection is shown in greater detail in FIG. 6. Specifically, the connection includes an angle bracket 60 which is bolted to stringer 42 of panel A1 and a second angle bracket 71 bolted to stringer 56 of panel A2.

Figure 6:
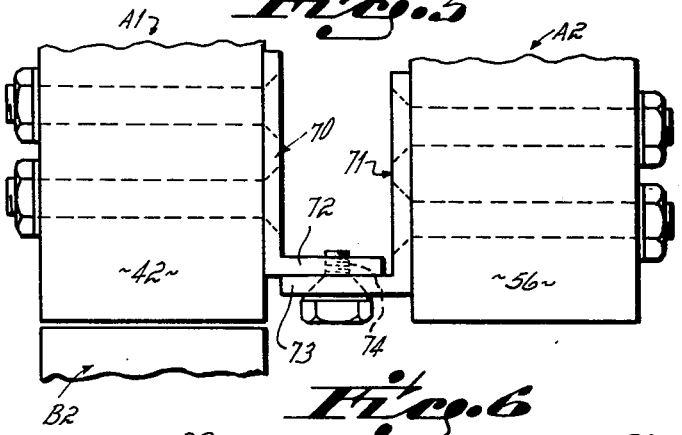
FIG. 6 is a view similar to FIG. 5 of the area designated 6 in FIG. 4.

The angle brackets 70 and 71 have cooperating legs 72 and 73 provided with openings for receiving bolt 74. This bolt threadably engages the opening in bracket 72 to rigidly secure panels A1 and A2 in assembled relationship. Again, the connection shown in FIG. 6 is located entirely below the playing surface of the two floor sections A1 and A2.

Referring briefly again to FIG. 4, all of the panels which are not on the periphery of the finally assembled floor are identical to each other. Each of these interiorly located floor panels includes two connections along one edge (the lower edge in FIG. 4), with the adjoining panels in the same row. These connections are located at the positions indicated by the circular arrows labeled 9.

In addition to the two connections with adjacent floor panels in the same row, each interiorly located floor panel connects to one floor panel in each adjacent row. For example, the panel B2 is connected at its upper righthand corner to the middle of the lower edge of the panel A2. The location of this connection is indicated by a circular arrow labeled 7. Additionally, the panel B2 is connected at a point midway along its lower edge with the upper righthand corner of the panel C1. The location of this connection is also indicated by a circular arrow labeled 7.

Figure 7:
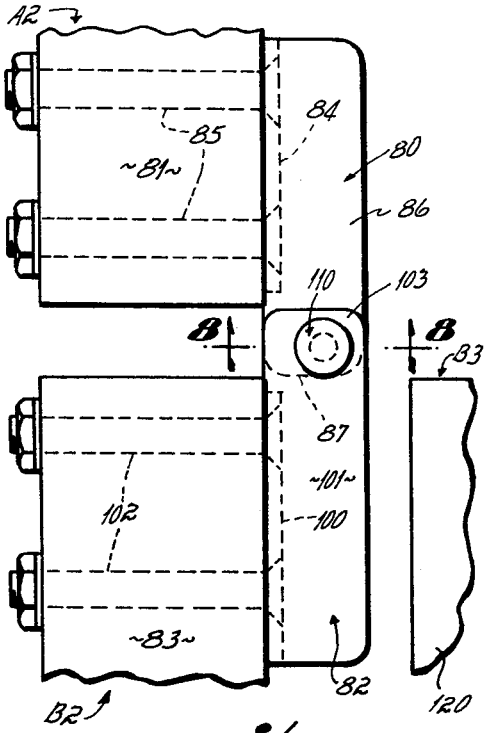
FIG. 7 is a view similar to FIG. 5 of the area labeled 7 in FIG. 4.
Figure 8:
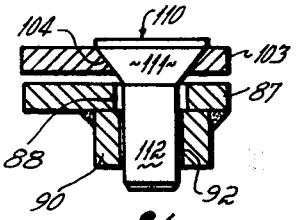
FIG. 8 is a vertical sectional view taken along section line 8—8 of FIG. 7.

The subsurface drop pin connection between floor panels at positions indicated by the circular arrows labeled 7 in FIG. 4 is shown in greater detail in FIGS. 7 and 8. As there shown, the panels being joined are panels B2 and A2. The connection includes a first, or lower, bracket 80 bolted to a middle stringer 81 of panel A2, and a second, or upper, bracket 82 bolted to end stringer 83 of panel B2. The overall relationship of the connection to panels B2 and A2 is best seen in FIGS. 4 and 2. As there shown, stringer 81 is disposed on the undersurface of panel A2 and extends perpendicular to the long edges of that panel, while stringer 83 is the rightmost end stringer disposed on the undersurface of panel B2. When the panels are assembled, stringers 81 and 83 extend parallel to one another with their axes in alignment.

Bracket 80 is preferably made from angle iron. The bracket includes a depending leg 84 which abuts the vertical edge of stringer 81. A portion of this leg is cut away so that the leg terminates short of the end of stringer 81. Bracket 80 is secured to stringer 81 in any suitable manner, such as by means of bolts and nuts indicated at 85.

Bracket 80 also includes a horizontally extending arm 86 which extends beyond the short edge 79 of panel B2 and extends outwardly beyond the long edge 89 of panel A2 as at 87. Horizontal arm extension 87 has a hole 88, shown in greater detail in FIG. 8, which passes perpendicularly through the arm. A boss 90, welded to the undersurface of the arm, has a cylindrical bore 92 which is in axial alignment with the hole 88.

The connection shown in FIG. 7 includes a second, or upper, bracket 82. This bracket includes a depending leg 100 and a horizontal arm 101. Leg 100 terminates short of the end of stringer 83 and is mounted as by means of bolts and nuts indicated generally at 102 to the outer edge of stringer 83. This stringer, as indicated in FIG. 4, is the rightmost stringer located on the underside of panel B2. Bracket 82 is mounted so that its horizontal arm 101 extends parallel to, and above, the level of arm 86 of lower bracket 80. Arm 101 of bracket 82 extends outwardly from the short edge 79 of panel B2 as at 103 and extends outwardly beyond the long edge 99 of the panel. This endwise portion 103 of arm 101 has a downwardly tapered aperture 104 formed therein (FIG. 8).

The brackets 80 and 82 are joined to the axially aligned stringers 81 and 83, respectively, so that when panels A2 and B2 are properly positioned, the tapered hole 104 and the hole 88 are aligned with each other. These holes receive a pin drop 110 which has a tapered head 111 and an elongated cylindrical shank 112. Since the openings 104 and 88 are accessible from above prior to the positioning of panel B3 (FIG. 4), pin 110 is merely dropped into position to lock brackets 80 and 82 together. In the event that panels A2 and B2 are not completely aligned and, hence, openings 104 and 88 are not perfectly aligned, pin 110 is inserted through the larger opening 104 into smaller opening 88. If the pin is canted, its tapered head engages a portion of the tapered wall of opening 104. As the pin is tapped with a hammer and forced downwardly, these mating tapers free the bracket openings and, hence, the panels into alignment.

Pin 110 is preferably made from a magnetically responsive material, such as steel. Consequently, the pin can be easily removed when the floor is being dismantled by touching it with a magnet and lifting it. It will be understood that when the floor is being removed, as adjacent floor panels are disconnected, the brackets between the floor panels become exposed, permitting access to the drop pins. Consequently, connections of the type shown in FIGS. 7 and 8 are both easily connected and disconnected to thereby facilitate speedy assembly or disassembly of a sectional floor.

Figure 9:
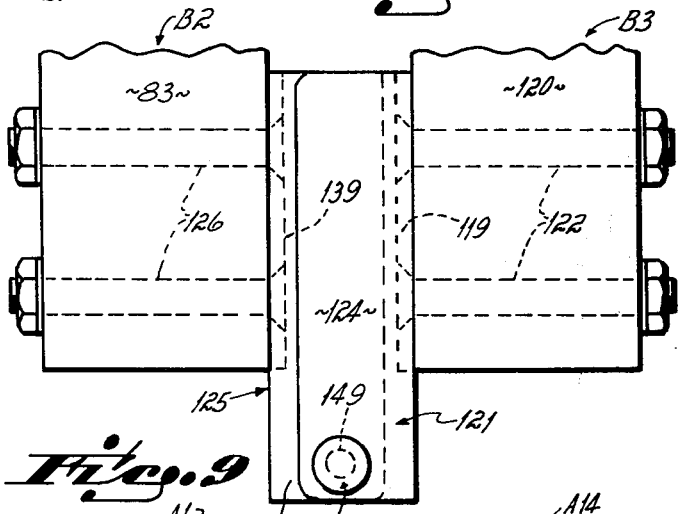
FIG. 9 is a view similar to FIG. 5 of the area labeled 9 in FIG. 4.

FIG. 9 shows a connection for joining adjacent interior panels in the same row. These connections are located at positions indicated by the circular arrows labeled 9 in FIG. 4. By way of example, the connection of FIG. 9 corresponds to the connection point between the B2 and B3 panels indicated by the circular arrow labeled 9 at the bottom right corner of the floor section B2 in FIG. 4. This connection includes an upper bracket 121 associated with panel B3 and a lower bracket 125 carried by panel B2. Bracket 121 has a depending leg 119 which is bolted to the left side of the stringer 120 by means of bolts 122. Leg 119 terminates short of the end of stringer 120. Bracket 121 also includes a horizontally disposed arm 124 which extends beyond the adjacent long edge of panel B3. Arm 124 has a tapered opening (not shown) formed adjacent to its end in a manner similar to tapered opening 104 in arm 103.

Lower bracket 125 includes a depending leg 139 bolted to stringer 83 as by means of bolts 126. Bracket 125 also includes a horizontal arm 130 which extends parallel to, and under, arm 124 when the B2 and B3 sections are properly positioned. Arm 130 includes an opening 149 which is aligned with a hole in a boss welded to the undersurface in the same manner as boss 90. The connection is completed by means of a drop pin 132 having a tapered head and cylindrical shank-like pin 110.

The vertical relationship of the brackets forming the type of connection shown in FIG. 9 can be seen in FIG. 3. Legends have been applied to this view illustrating the manner in which a panel, such as B1, is interconnected to a panel B2 which in turn is connected to panel B3. It will be appreciated that in making the connection, the end panels B1 and B3 would be shifted inwardly until the upper bracket 121 on panel B3 overlies the lower bracket 125 on panel B2. Similarly, the upper bracket 200 of panel B2 overlies lower bracket 201 of panel B1. Drop pins are then inserted through the aligned holes in these brackets to lock the panels in place.

While the foregoing discussion has indicated that the horizontal arms of the various brackets should be located in particular planes, it is clear that the planar relationship of these horizontal arms can be reversed. For example, in FIG. 7 the horizontal arm 86 underlies the horizontal arm 101. Clearly, this relationship could be reversed. A similar reversal of the horizontally disposed portions of the connectors of FIG. 9 can also be made.

Figure 10:
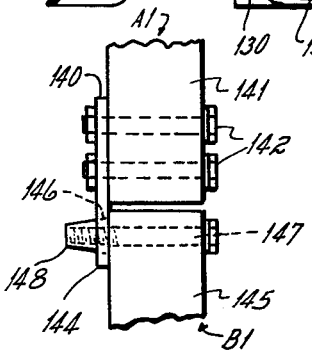
FIG. 10 is a view similar to FIG. 5 of the area labeled 10 in FIG. 4.

FIG. 10 shows a typical connection between adjacent floor panels along the leftmost edge of the assembled floor. These connections are indicated by the doubleheaded arrows labeled 10 in FIG. 4. The connection of FIG. 10 is shown as joining panels A1 and B1. This connection includes a metal plate 140 which is bolted, as by means of bolts 142, to the left side of stringer 141 of panel A1. This stringer 141 is the endmost stringer of the first floor panel in the A row.

Plate 140 has a portion shown generally at 144 which extends beyond the end of the stringer 141 and this portion 144 lies alongside the left vertical side of the end stringer 145 of panel B1. Extending portion 144 has a hole 146 passing therethrough which is slightly elongated in the vertical direction. A threaded bolt 147 passes through the stringer 145 and engages interior threads on a tapered nose member 148. Nose member 148 has a maximum diameter just smaller than the horizontal width of the hole 146 so that the nose can act like a slip pin which is self-aligning, but which can seat firmly against lateral movement in hole 146. The nose is free to move vertically, however, to permit the tongue and grooves of the floor panels to seat. It will be appreciated that both plate 140 and nose 148 are disposed beneath the plywood subfloor 21.

Figure 11:
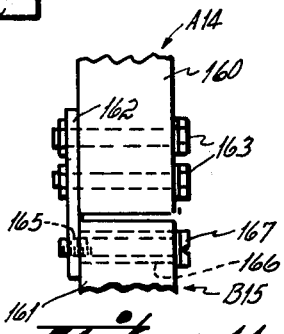
FIG. 11 is a view similar to FIG. 5 of the area labeled 11 in FIG. 4.

FIG. 11 shows the subfloor connection between adjacent floor panels along the rightmost edge of the assembled floor. These connections are located at positions indicated by the doubleheaded arrows labeled 11 in FIG. 4. The rightmost stringer, for example, stringer 160 for panel A14, is aligned with the endmost stringer, for example, stringer 161 of the B15 floor section. A flat plate 162 is bolted by bolts 163 to the stringer 160. A portion of the plate 162 extends laterally beyond the end of stringer 160 so as to lie alongside of the left vertical side of the stringer 161. A threaded opening 165 is formed in this laterally extending portion.

Stringer 161 is provided with a transverse through bore 166. This bore 166 is preferably elongated in a horizontal direction. A threaded bolt 167 can pass through the bore 166 and engages the threaded opening 165 in plate 162 to secure stringer 161 against plate 162. The head of the bolt is larger than the height of the bore 166 so that the bolt 167 can be tightened into the threaded bore 165. The connection shown in FIG. 11 is located beneath the plywood subfloor 21 and is accessible for connecting and disconnecting sections together only from the end of the assembled floor.

Figure 12:
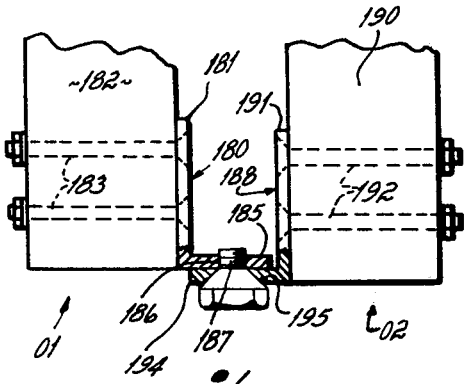
FIG. 12 is a view similar to FIG. 5 of the area labeled 12 in FIG. 4.

FIG. 12 shows the subfloor connection between adjacent panels along the fourth peripheral edge of the floor, i.e., the panels of the O row in FIG. 4. This connection is similar to the connection shown in FIGS. 5 and 6 and is illustrated as joining panels O1 and O2. The connection includes an angle bracket member 180 with a leg 181 bolted as by means of bolts 183 to the outer edge of stringer 182. This stringer 182 is the rightmost stringer of the O1 floor panel. Bracket 180 also includes an arm 185 disposed perpendicular to the leg 181. This arm 185 includes a threaded hole 186 which receives bolt 187. A second bracket 188 includes a leg 191 bolted to stringer 190. This latter stringer is the leftmost stringer of the O2 floor section. Bracket 188 includes a leg 191 secured to the stringer by bolts 192 and an arm 194 disposed perpendicularly to leg 191. Arm 194 has a tapered slot 195. Bolt 187 passes through the slot 195 and engages the threaded hole 186 in bracket 180 to lock brackets 180 and 188 together. Again, this connection is made completely below the subfloor 21 and is accessible only from the edge of the floor.

While the various types of connections have been described individually above, it is felt that the four different types of connections associated with each interior panel can best be appreciated from a consideration of FIG. 2 which can be considered as depicting the panel B2. As there shown, panel B2 carries four connector brackets. The first bracket is an upper type bracket 200 disposed on the lower lefthand corner and adapted for connection to the adjacent panel in the B row, i.e., panel B1. The second bracket 82 carried by panel B2 is an upper bracket located in the diagonally opposite corner. This bracket is disposed for connection to an adjacent panel in the next row, i.e., panel A2.

The third bracket 125 is disposed at a corner on the same elongated edge as bracket 200. Bracket 125 is a lower bracket disposed for connection to the next adjacent panel in the B row, i.e., panel B3. The fourth bracket carried by panel B2 is lower bracket 180 carried by a stringer disposed at the middle of the long edge of the panel. This bracket is adapted for connection to an adjacent panel in the C row, i.e., panel C1.

While the foregoing discussion has been made with particular emphasis on a preferred embodiment of the invention, it will be readily recognized by those skilled in the art that numerous modifications in form only can be made without departing from the spirit and scope of the invention. For example, while the finish surface in the preferred embodiment has been described as being made of hard maple boards, this surface could be of any other desired type, for example, a synthetic surface. Furthermore, it is contemplated in some installations that it may be desirable to provide a sectional floor which can be removed but which normally would be left in place for several months, e.g., throughout an entire basketball season. In such a floor, it is desirable to prevent any separation of the panels which might occur through protracted usage. To this end the panel construction is modified so that it is like that of the preferred embodiment, except that the bosses secured to the lower brackets, such as bracket 80, are threaded. Similarly, the shanks of pins 110 are threaded. Thus all of the panels are rigidly co-nected and no panel separation occurs even after periods of protracted usage. Accordingly, I desire to be limited only by the scope of the following claims.

What is claimed is:

1. A floor panel for use in fabricating sectional floors of the type having an uninterrupted upper surface and including a plurality of like panels, said panel comprising:

a rectangular finished horizontal upper surface having first and second long edges interconnected by two short edges;

first, second, third and fourth brackets mounted beneath said finished surface for forming subsurface connections releasably locking said panel to adjacent panels;

each of said brackets comprising a horizontal arm lying in a plane below the plane of said finished upper surface and extending outwardly beyond the periphery of said panel and adapted to lie in superimposed relationship with a cooperating bracket on an adjacent panel;

said first bracket horizontal arm extending from said panel outwardly beyond a straight line coincident with said first long edge thereof adjacent to a first corner of said panel, said second bracket horizontal arm extending from said panel outwardly beyond a straight line coincident with a first short edge thereof adjacent to a second corner diagonally opposite said first corner, said third bracket horizontal arm extending from said panel outwardly beyond a straight line coincident with the first long edge of said first corner adjacent to a third corner of said panel, and said fourth bracket horizontal arm extending from said panel outwardly beyond a straight line coincident with the intermediate portion of said first long edge;

said first and third arms each being located in different vertical planes below said plane of said finished upper surface to facilitate said superimposed relationship with a cooperating bracket of an adjacent panel when assembled therewith, and said second and fourth arms each being located in different planes below said plane of said finished upper surface to facilitate said superimposed relationship with a cooperating bracket of an adjacent panel when assembled therewith;

each of said horizontal arms having an opening therein disposed entirely outwardly of the periphery of said finished surface and adapted to receive a headed drop pin, said openings of said first, third and fourth arms being located entirely outwardly beyond a straight line coincident with said first long edge, and said opening of said second arm being located entirely outwardly beyond said first short edge and located entirely inwardly of a straight line coincident with said second long edge, said drop pin being adapted to be inserted downwardly through said opening and through an aligned opening in the cooperating bracket of the adjacent panel to lock said panels together.

2. The floor panel of claim 1 wherein said panel is shaped with a tongue extending along one long edge and one short edge and a groove for receiving a tongue of an adjacent panel along the other edge and the other short edge.

3. The floor panel of claim 1 in which the horizontal arms of said first and second brackets are disposed at one level and the horizontal arms of said third and fourth brackets are disposed at a second level.

4. The floor panel of claim 3 in which the openings in the horizontal arms disposed at an upper level are tapered and the heads of said drop pins are tapered.

5. The floor panel of claim 1 further comprising a plurality of parallel stringers disposed beneath said finished surface, means mounting said finished surface upon said stringers, each of said brackets being an angle bracket and including a vertical leg mounted upon one of said stringers.

6. The floor panel of claim 5 in which said vertical legs terminate short of the end of the stringer to which it is attached.

7. The floor panel of claim 6 in which said horizontal arms extend parallel to said short edges of said panel.

8. A rectangular sectional floor having an uninterrupted upper surface and comprising in combination:

a first plurality of peripheral rectangular panels disposed along the periphery of said floor;

a second plurality of interior panels disposed interiorly of said peripheral panels, each of said peripheral panels and said interior panels having a horizontal upper rectangular finished surrface;

said peripheral panels and said interior panels being disposed in parallel rows, the panels of one row being staggered with respect to the panels of an adjacent row;

means for bolting together the peripheral panels of at least one row;

drop pin connection means for releasably securing the interior panels to one another and to the peripheral panels, each interior panel being secured to the adjacent panels in the same row and one panel in each adjacent row, the drop pin connection means including a plurality of headed drop pins for forming subsurface connections releasably locking said panel to adjacent panels;

each of said brackets comprising a horizontal arm lying in a plane below the plane of said finished upper surface and extending outwardly beyond the periphery of said panel and adapted to lie in superimposed relationship with a cooperating bracket on an adjacent panel;

said first bracket horizontal arm extending from said panel outwardly beyond a straight line coincident with said first long edge thereof adjacent to a first corner of said panel, said second bracket horizontal arm extending from said panel outwardly beyond a straight line coincident with a first short edge thereof adjacent to a second corner diaganolly opposite said first corner, said third bracket horizontal arm extending from said panel outwardly beyond a straight line coincident with the first long edge of said first corner adjacent to a third corner of said panel, and said fourth bracket horizontal arm extending from said panel outwardly beyond a straight line coincident with the intermediate portion of said first long edge;

said first and third arms each being located in different vertical planes below said plane of said finished upper surface to facilitate said superimposed relationship with a cooperating bracket of an adjacent panel when assembled therewith, and said second and fourth arms each being located in different planes below said plane of said finished upper surface to facilitate said superimposed relationship with a cooperating bracket of an adjacent panel when assembled therewith;

each of said horizontal arms having an opening therein disposed entirely outwardly of the periphery of said finished surface and adapted to receive a headed drop pin, said openings of said first, third and fourth arms being located entirely outwardly beyond a straight line coincident with said first long edge, and said opening of said second arm being located entirely outwardly beyond said first short edge and located entirely inwardly of a straight line coincident with said second long edge, said drop pin being adapted to be inserted downwardly through said opening and through an aligned opening in the cooperating bracket of the adjacent panel to lock said panels together.

9. The sectional floor of claim 8 in which said openings in the uppermost of said superimposed brackets are tapered, and said drop pins include tapered heads.

10. The sectional floor of claaim 8 in which each said interior panel further comprises a plurality of parallel stringers disposed beneath said finished surface, means mounting said finished surface upon said stringers, and each of said brackets is an angle bracket and includes a vertical leg mounted upon one of said stringers.

11. The sectional floor of claim 8 in which the horizontal arms of said first and second brackets are disposed at one level and the horizontal arms of said third and fourth brackets are disposed at a second level.

12. The sectional floor of claim 11 in which the first bracket of one interior panel is interconnected with the third bracket of an adjacent panel in the same row, the second bracket of said interior panel is interconnected with the fourth bracket of said panel in the next adjacent row, the third bracket of said panel is interconnected with the first bracket of a second panel in the same row, and the fourth bracket of said panel is interconnected with the second bracket of the panel in a second adjacent row.

* * * * *

UNITED STATES PATENT OFFICE

CERTIFICATE OF CORRECTION

PATENT NO. : 3,967,428

DATED : July 6, 1976

INVENTOR(S) : Arthur W. Pierce; Robert A. Stoehr

It is certified that error appears in the above-identified patent and that said Letters Patent are hereby corrected as shown below:

Column 10, line 15 after "other", first occurrence, insert -- long --.

Column 12, line 8 "claaim" should be -- claim --.

Signed and Sealed this

Twenty-first Day of September 1976

[SEAL]

*Attest:*

RUTH C. MASON
*Attesting Officer*

C. MARSHALL DANN
*Commissioner of Patents and Trademarks*